United States Patent [19]

Aaltonen et al.

[11] 4,259,106

[45] Mar. 31, 1981

[54] PROCESS FOR THE ROASTING AND CHLORINATION OF FINELY-DIVIDED IRON ORES AND CONCENTRATES CONTAINING NON-FERROUS METALS

[75] Inventors: Olavi A. Aaltonen; Juho K. Mäkinen, both of Pori, Finland

[73] Assignee: Outokumpu Oy, Helsinki, Finland

[21] Appl. No.: 35,850

[22] Filed: May 4, 1979

[30] Foreign Application Priority Data

May 11, 1978 [FI] Finland ..... 781493

[51] Int. Cl.[3] ..... C22B 1/08

[52] U.S. Cl. ..... 75/7; 75/9; 75/23; 75/25; 75/26; 75/114; 423/153; 423/154

[58] Field of Search ..... 75/7, 8, 23, 26, 25, 75/114; 423/153, 154

[56] References Cited

U.S. PATENT DOCUMENTS

| | | | |
|---|---|---|---|
| 3,499,754 | 3/1970 | Colombo et al. | 75/113 X |
| 3,649,245 | 3/1972 | Columbo et al. | 75/9 |
| 3,776,533 | 12/1973 | Vlnaty | 75/9 X |
| 4,092,152 | 5/1978 | Borbely | 75/7 |
| 4,113,470 | 9/1978 | Aaltonen et al. | 75/23 X |

FOREIGN PATENT DOCUMENTS

| | | | |
|---|---|---|---|
| 7001526 | 8/1970 | Netherlands | 75/23 |
| 1205453 | 9/1970 | United Kingdom | 75/23 |

*Primary Examiner*—G. Ozaki

*Attorney, Agent, or Firm*—Brooks, Haidt, Haffner & Delahunty

[57] ABSTRACT

Finely-divided iron ores and concentrates which contain non-ferrous metals are roasted and chlorinated in order to vaporize the non-ferrous metals as metal chloride compounds, whereby the finely-divided raw material is oxidized at an elevated temperature to produce an oxide melt, with which a chlorinating reagent and air are mixed in order to vaporize non-ferrous metal chlorides from the iron oxide melt.

7 Claims, 6 Drawing Figures

DISTRIBUTION OF THE ELEMENTS

DISTRIBUTION OF THE ELEMENTS

Ore
Fe S Zn Pb
100 100 100 100
Cu As Ca Cl
100 100 4,6 -
Calcine
Fe S Zn Pb
- - - -
Cu As Ca Cl
- - 80,1 -
Flash melting furnace
Gas
Fe S Zn Pb
- 94,0 - -
Cu As Ca Cl
- 60,0 - -
Dust
Fe S Zn Pb
7,4 5,3 47,7 55,8
Cu As Ca Cl
9,4 44,0 5,2 -
Ca Cl 2
Fe S Zn Pb
- - - -
Cu As Ca Cl
- - 15,3 100
Chloride dust
Fe S Zn Pb
3,8 0,4 50,3 41,7
Cu As Ca Cl
82,4 8,0 2,1 96,3
Chlorination furnace
Smelt
Fe S Zn Pb
92,6 0,7 52,3 44,2
Cu As Ca Cl
90,6 16,0 81,5 -
Chlorinated smelt
Fe S Zn Pb
88,7 0,1 2,0 2,5
Cu As Ca Cl
8,2 8,0 92,7 0,6

PROCESS FOR THE ROASTING AND CHLORINATION OF FINELY-DIVIDED IRON ORES AND CONCENTRATES CONTAINING NON-FERROUS METALS

BACKGROUND OF THE INVENTION

The present invention relates to a process for the roasting of finely-divided iron ores and concentrates containing non-ferrous metals such as zinc, lead, copper, gold and silver, especially pyrite and pyrrhotite concentrates and ores, preferably in a flash-smelting furnace, and for their chlorination in a separate stage in order to vaporize the non-ferrous metals as metal chloride compounds.

Several sulfidic non-ferrous metal ores frequently contain not only the metal mineral ores concerned but also iron sulfides, pyrite or pyrrhotite, which can be recovered separately in a more or less pure form by concentration techniques. The currently known methods for processing these iron sulfides are based on the classical dead roasting and the production of $SO_2$ gas, or their thermal decomposition and the production of elemental sulfur. If the sulfidic concentrates are sufficiently pure, the obtained roasting residue is suitable for iron production. This proportion of iron ore is usually an important one in respect of the economy of the processes. If these iron sulfides are not obtained in a form sufficiently free from non-ferrous minerals, as is often the case, the obtained calcine is not as such suitable for use as iron ore but must be treated further for the removal of the metals, often valuable in themselves. Various chlorination methods have been studied and developed for this purpose.

Methods used on an industrial scale include only the so-called Kowa Seiko process, in which calcium chloride is mixed with the calcine and the mixture is pelletized and heated in a revolving tubular furnace by countercurrent heating to a temperature of approximately 1250° C., whereby the non-ferrous metals sublimate as chlorides and are then recovered from the gases. The hematite pellets thus purified are a suitable raw material for an iron-smelting plant. This process is applicable only to a calcine which has been roasted to a state very low in sulfur, and the metal contents to be vaporized must not be very high (2.5% in total). Another disadvantage is the high heat requirement of the chlorination and sintering.

Other processes, at a pilot plant stage, include the Montedison, LDK and Outokumpu processes.

Montedison is a 3-stage process, in which the heating and final oxidation of the calcine are carried out in the first stage, the hematite is reduced to magnetite in the second stage, and the third stage comprises chlorination with an air-bearing chlorine gas at a temperature of approximately 950° C., by oxidizing magnetite yielding the necessary heat. The reactors are fluidized-bed reactors and operate in a series. The gases from the chlorination are directed to a wash for the recovery of the chlorides. The finely-divided product obtained is pelletized and sintered separately. Oil must be used for the preheating, the reduction and the sintering of the pellets.

The LDK and Outokumpu processes are based on the chlorination of calcine with gaseous chlorine in a shaft furnace. The former utilizes pre-pelletized calcine and the latter finely-divided hot calcine directly. Both processes involve a problem in keeping the heating and cooling zones distinctly separate and on an industrial scale an even distribution of chlorine in the shaft furnace.

All these processes are characterized in that the roasting is performed at a temperature below the melting point of the product and that the chlorination is carried out in solid state with solid $CaCl_2$ or chlorine gas, and that these must be used in considerable excess over the theoretical requirement. The calcine is either pelletized or sintered before the chlorination, as in the Kowa Seiko process, or after the chlorination and before being fed into the smelting plant, as in the Montedison process. External fuel must be used for this drying, heating and sintering. Only part of the heat of reaction contained in the concentrate is used in the process itself; it is used for maintaining the roasting temperature, and often heat is also stored in the vapor during the roasting and recovered.

Not only chlorination but also sulfatizing is used in processing certain types of iron sulfide concentrates. However, for example lead and noble metals cannot be recovered in the sulfatizing process, but they remain in the roasting residue. The calcium and barium present in the concentrate also sulfatize easily and, being insoluble, they bind sulfur in the calcine and thereby the grade of the iron ore is lowered.

The object of the present invention is to eliminate the above disadvantages and to provide a process for the treatment of finely-divided ores and concentrates to produce iron oxide suitable for iron production and non-ferrous chlorides from which valuable metals can be recovered by methods known per se, the process also being advantageous in terms of heat economy and environmental protection.

SUMMARY OF THE INVENTION

The above advantages are gained by oxidizing a finely-divided ore or concentrate to a high degree to form an oxide melt and by exposing this melt to chlorination in a separate zone. In the present invention the roasting is thus preformed at a very high temperature, preferably a temperature above 1500° C., and under conditions so highly oxidizing that the product is an oxide melt the solidification point of which can be lowered to 1200°–1350° C. in lieu thereof by means of calcium oxide additions; and this melt is chlorinated in a separate zone. Thereby the thermal energy contained in the ore or concentrate is utilized effectively in the roasting and the heat content of the oxide melt is used for the chlorination, in which case in principle no additional heat is needed. The chlorinating reagent can also be mixed effectively with the oxide melt and the chlorination zone can also be easily isolated from the roasting zone by a gas lock, for example. The quantity of the chlorinating reagent is also considerably smaller than previously.

In the present invention the thermal energy contained in the iron sulfides is thus used with maximal efficiency in the process itself. The roasting is carried out preferably in a suspension, applying Outokumpu Oy's known flash-smelting process at a temperature of over 1500° C. Thus the principal product is an iron oxide melt having a temperature of 1300°–1500° C. and which is a mixture of ferrous and ferric oxides and in which the gangue components, such as $SiO_2$, CaO, $Al_2O_3$ and MgO, present in the ore or concentrate also dissolve. In practice the said gangue components lower the melting point of the oxide melt produced and, when necessary, this can be regulated by an addition of CaO, for example. When necessary, the temperature can be controlled by preheating of the combustion air, oxygen enrichment of the combustion air and/or burning of fossil fuel, or external cooling or heat-binding additions to the ore or concentrate feed.

The gases are directed, in accordance with the standard flash-smelting method, to the waste-heat boiler and through electric filters to the treatment of $SO_2$, i.e. to the manufacture of sulfuric acid, $SO_2$ liquefaction, or the production of elemental sulfur. The process is continuous-working and even, and therefore the treatment of the gases is simple. Depending on the chemico-mineralogical composition of the pyrite concentrate, some of the non-ferrous metals present in the concentrate are concentrated in the gases, from which they condense with the rest of the fly dust, as do, for example, some of the Zn and Pb compounds, or continue their journey along with the gases, as do the As compounds.

In order to obtain these valuable metal compounds, which condense in the dusts, in one single product from the flash-smelting furnace, it is advantageous to return the fly dusts to the flash-smelting furnace, whereby they are all forced to go along with the melt being formed. The compounds which do not condense with the dusts, such as $As_2O_3$, are removed from the gases by washing the gases with a $H_2SO_4$ solution before the treatment of $SO_2$ gas.

The oxide melt accumulating in the flash-smelting furnace is withdrawn either continuously or intermittently into another furnace unit or to a section separated by a gas lock; molten calcium chloride or some other chloride with a low vapor and dissociation pressure is added into this unit or section at least in an equivalent amount, calculated on the basis of the valuable metals removed. The procedure can be illustrated by the following reaction equations:

$$MeO(1)+CaCl_2(1)\rightarrow MeCl_2(g)+CaO(1) \quad (1)$$

$$CaO(1)+FeO.Fe_2O_3(1)\rightarrow CaO.Fe_2O_3(1)+FeO(1) \quad (2)$$

$$MeO.Fe_2O_3(1)+CaCl_2(1)\rightarrow MeCl_2(g)+CaO.Fe_2O_3(1) \quad (3)$$

$$MeO.SiO_2(1)+CaCl_2(1)\rightarrow MeCl_2(g)+CaO.SiO_2(1) \quad (4)$$

The stoichiometric coefficients, which are either integers or fractions, have been excluded from the equations above. The CaO released from the $CaCl_2$ lowers the melting point of the oxide melt to such a degree that the thermal losses occurring during chlorination and the heat amount required for the heating of possible rinsing gas can be compensated for by allowing the temperature of the melt to drop close to the new melting point. In addition, CaO increases the activity of certain metals such as Zn and Pb by decomposing their ferrites and silicates.

The equilibrium constant for Reaction 1, in accordance with the law of mass action, is:

$$K_1 = \frac{P_{MeCl_2} \times a_{CaO}}{a_{MeO} \times a_{CaCl_2}} \quad (5)$$

which increases drastically with raising temperature (Table 3) and is, by definition, constant at a constant temperature. In Equation 5, a represents the activity of component and $P_{MeCl_2}$ the vapor pressure of the metal chloride concerned.

The CaO produced from $CaCl_2$ in the chlorination reactions dissolves in the oxide melt, whereby its activity declines sharply. This is a considerable advantage over chlorination carried out in solid state, in which the activity of the solid CaO produced has the value one. It is true that in the melt the activity of MeO is also lower than one, but the situation is the same as in a solid pyrite calcine, in which non-ferrous metals are usually combined in metal ferrites, metal silicates, etc.

The chlorination processes carried out in solid state with $CaCl_2$ have a weakness in that in practice they cannot be used for treating iron sulfide raw materials with a non-ferrous metal content higher than, for example, 2.5%, since the CaO produced lowers the melting point of the calcine pellets, which results in sintering of the batch. In the process according to our invention, the lowering of the melting point of the batch is an advantage, and therefore in practice there is no upper limit for the non-ferrous metal content in the iron sulfide raw material.

Metal chlorides such as Cu, Zn, Pb, Bi, Sb, Au, Ag, As, etc., vaporize, and they are condensed and separated from each other by known methods. The sulfur compounds possibly remaining in the melt also disperse and vaporize so that after the $CaCl_2$ treatment the melt does not contain, in excessive quantities, any impurities harmful to iron production. The melt can now be either granulated, cast into suitable pieces or fed directly as melt to iron production. The process is extremely suitable for large-scale production and is applicable to highly varied pyrites, both pure and impure. As the thermal energy generated during the oxidation of these pyrites is utilized effectively in the processing and smelting, and the excess heat is recovered in vapor, the entire process is economical in terms of energy. The vapor produced can be used for the production of oxygen possibly needed, for the preheating of the process air, or for the solution treatment of chlorides.

The problems of furnace cooling involved with the high reaction temperature can be solved by using, for example, the apparatus structure disclosed in U.S. Pat. No. 4,027,865, in which an autogenic lining condenses on the walls of the water-cooled reaction shaft and lower furnace, this lining consisting of high-melting iron oxides, silicates or aluminates, depending on the composition of the gangue present in the concentrate. The recovery of the valuable metals from the chlorides can be carried out, for example, as in the Kowa Seiko process (Yasutake Okubo: "Kowa Seiko Pelletizing Chlorination Process—Integral Utilization of Iron Pyrites", Journal of Metals, March 1968, pp. 63–67) or possibly by some other known method, depending on the possibilities for further treatment of the valuable metals. The process makes the cycling of chlorine possible since lime is used for the pH control of the chloride solution, in which case $CaCl_2$ can be crystallized out from the solution.

DESCRIPTION OF THE PREFERRED EMBODIMENTS

Figure 3A:
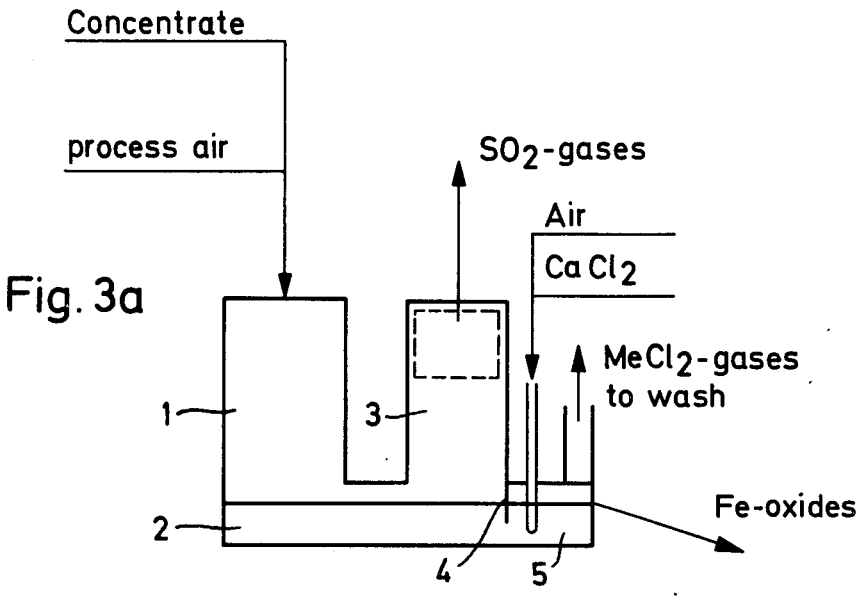
FIGS. 3*a* and 3*b* depict in more detail, as cross sections, the side and plan views of an apparatus intended for carrying out the process according to the invention.
Figure 3B:
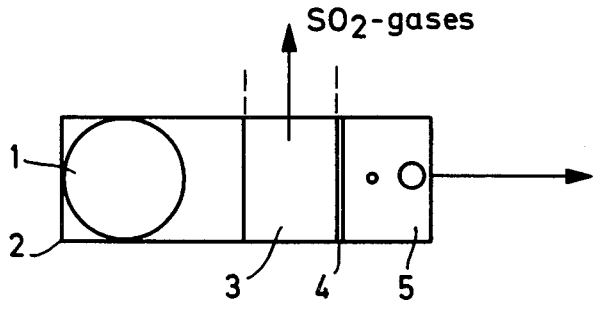
Figure 4:
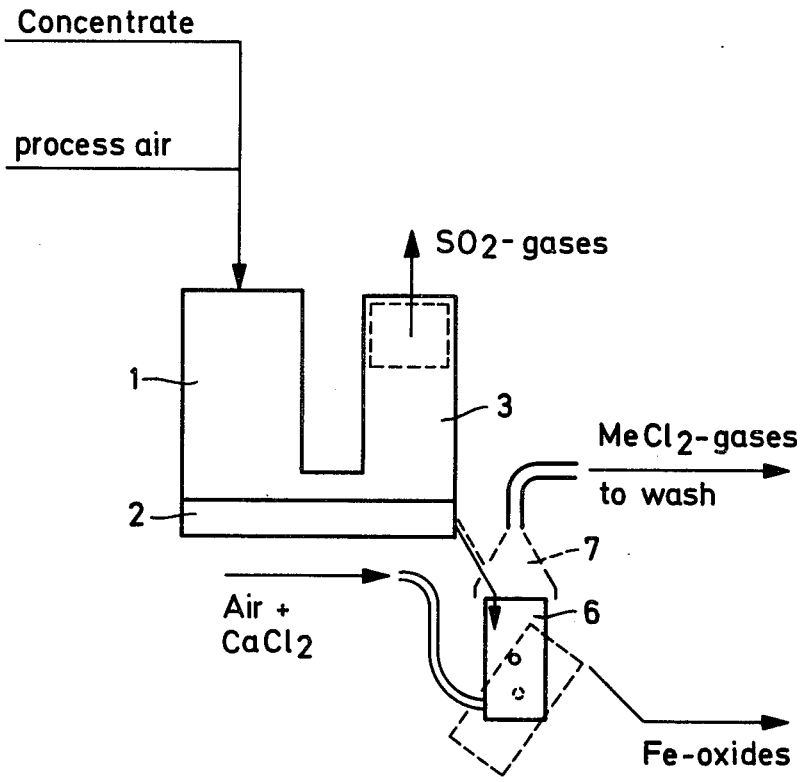
FIG. 4 depicts, as a cross section, a side view of another apparatus intended for carrying out the process according to the invention.
Figure 5:
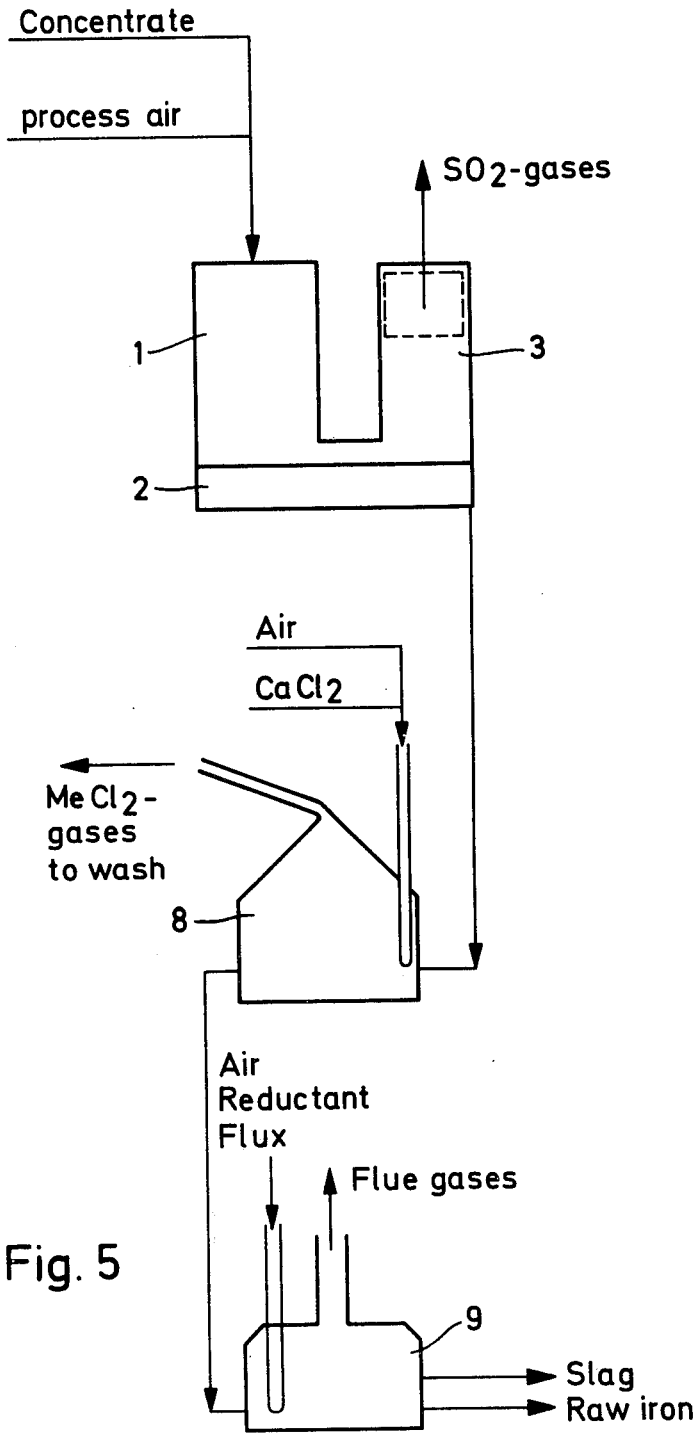
FIG. 5 depicts, as a cross section, a side view of a third embodiment.

In FIGS. 3–5, numeral 1 indicates the reaction shaft, 2 the lower furnace, 3 the rising shaft, 4 the gas lock, 5 the chlorination furnace, 6 the chlorination ladle, 7 the gas collector, 8 the chlorination reactor, and 9 the reduction furnace.

Thus, FIGS. 3, 4 and 5 depict various embodiments of the process according to the invention. In FIG. 3 the chlorination is carried out as a continuous-working process in a chlorination section 5 which is a continuation of the flash-smelting furnace; the gas chamber of this section is separated from the flash-smelting furnace chamber by a gas lock 4. In FIG. 4, the smelting is continuous-working, but the chlorination is a batch process. Calcium chloride and air can be fed to the bottom 6 of the chlorination ladle, as in FIG. 4, or the calcium chloride can be placed at the bottom of the ladle before oxide melt is run from the flash-smelting furnace, using air only for mixing and maintaining the oxygen pressure. In FIG. 5 all processes are continuous-working and the reduction to crude iron in a reduction furnace 9 of the iron oxide melt purified in the chlorination reactor 8 is linked to these processes.

Figure 1:
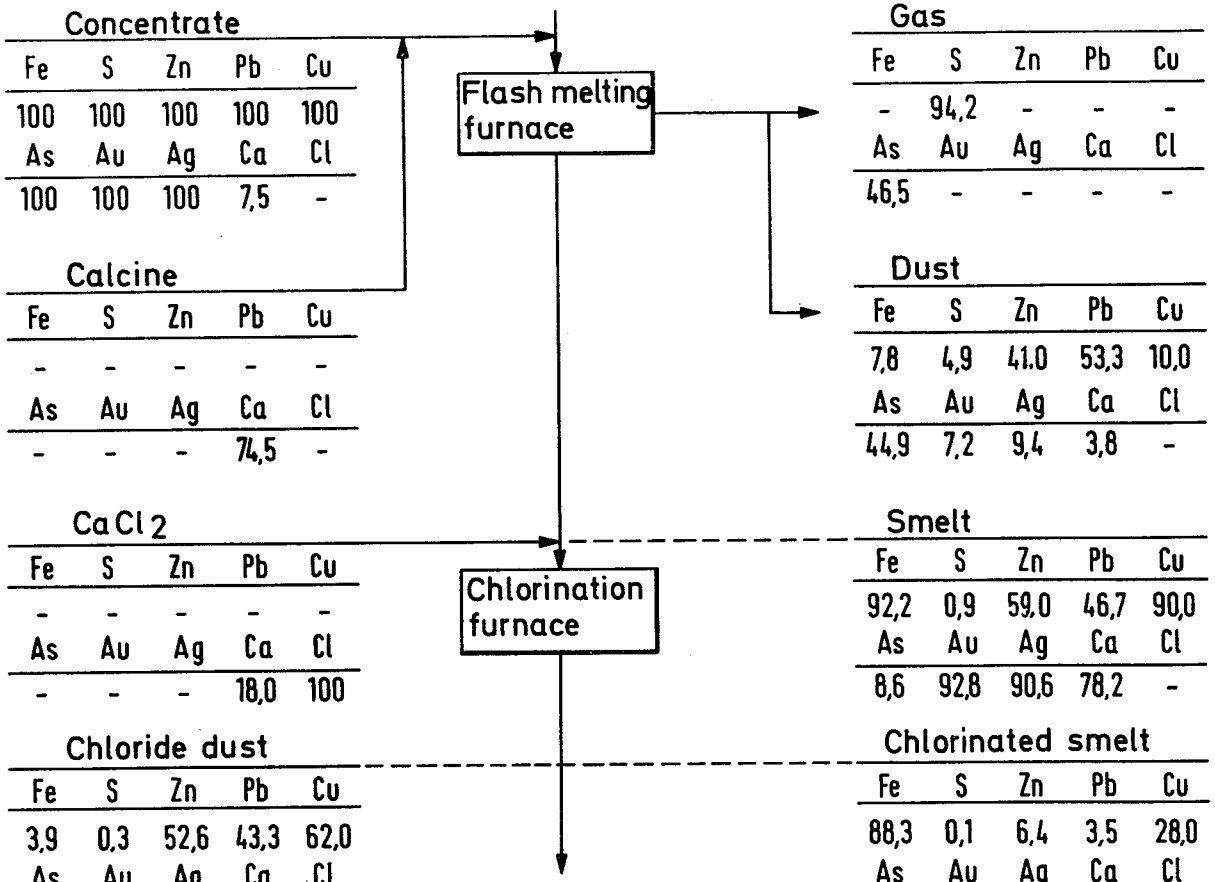
FIGS. 1 and 2 depict the flow diagram and element distributions of the process according to the invention.

The invention is described below in more detail with the aid of examples, which have been obtained by performing trial runs in an industrial-scale flash-smelting furnace and chlorination furnace, the capacity being approximately 1 t/h ore or concentrate. The pyrite raw materials according to the examples differ from each other primarily in their chemical composition. Tables 1 and 2 show the quantities of material involved and the concentrations of the most important components both in the flash smelting and the chlorination, calculated for a concentrate or ore feed of 1 t/h. The quantitative distributions of the principal components are shown in the block diagrams, FIGS. 1 and 2.

EXAMPLE 1

Example 1 illustrates the behavior of a pyrite concentrate which contains large quantities of arsenic and nobel metals in the flash-smelting furnace (FSF) developed by Outokumpu Oy and in the chlorination furnace following it. The fly dust obtained from the waste-heat boiler and the electric filter is not cycled, owing to its high arsenic content. The thermal balance of the reaction shaft is controlled primarily by oxygen enrichment of the combustion air, whereby the total gas volume and thereby also the volume of fly dust can be maintained relatively low in spite of the high concentration of volatile components in the concentrate. The chlorination is performed in a separate chlorination unit by means of molten $CaCl_2$. Air is blow into the smelt at a rate allowed by the thermal balance, in order to oxidize the ferrous iron and sulfur and to promote the vaporization of the chlorides.

Table 1 shows that the sulfur concentration in the melt drops to 0.55% and the arsenic concentration to 0.86% in the FSF. The chlorinated melt contains only 0.06% S, 0.09% Zn, 0.03% Pb, and 0.08% As and is therefore highly suitable for iron production. The chlorine dust produced, which contains not only the vaporized and condensed chlorides but also mechanically produced, partly sulfatized fly dust, is washed with water, and the valuable metals are recovered by mainly hydrometallurgical methods from the solution and precipitate produced.

From the quantitative distribution scheme of the principal components (FIG. 1) it can be seen that 99.1% of the sulfur, 91.4% of the arsenic, 41.0% of the zinc, and 53.3% of the lead can be eliminated at the smelting stage already, which is a considerably better result than that obtained in conventional roasting processes. The yields of valuable metals passed into the chloride dusts are Au 86.1% and Ag 81.8%. The total yields passed into the dusts are:

| | |
|---|---|
| Zn | 93.6 |
| Pb | 96.6 |
| Cu | 72.0 |
| Au | 93.3 |
| Ag | 91.2 |

As regards the chlorinated melt, attention is drawn to the fact that the concentration of sulfur in it is only 0.1% and that of arsenic 0.8%. This is due to the effective elimination of the said elements not only in the FSF but also in the chlorination unit. The sulfur and arsenic compounds, and partly also metal chlorides, sublimated in the hot end (approximately 1250° C.) of a countercurrent Kowa Seiko cylinder furnace, where the chlorination is performed in solid state, tend to condense in the cold end, where the temperature of the feed is only approximately 500° C. This causes an accumulation of the said compounds in the reactor and an increase in their concentration in the chlorinated calcine.

EXAMPLE 2

Example 2 illustrates the behavior of a finely-divided pyrite ore which contains large amounts of zinc, lead, and copper, treated by the process according to Example 1. Table 2 shows that the chlorinated smelt contains 0.04% S, 0.1% Zn, 0.04% Pb, 0.1% Cu, and 0.06% As, and thus it is also highly suitable for iron production. The sulfatized fly dust from the FSF is suitable for being treated in, for example, a zinc plant based on roasting and electrolysis.

Figure 2:
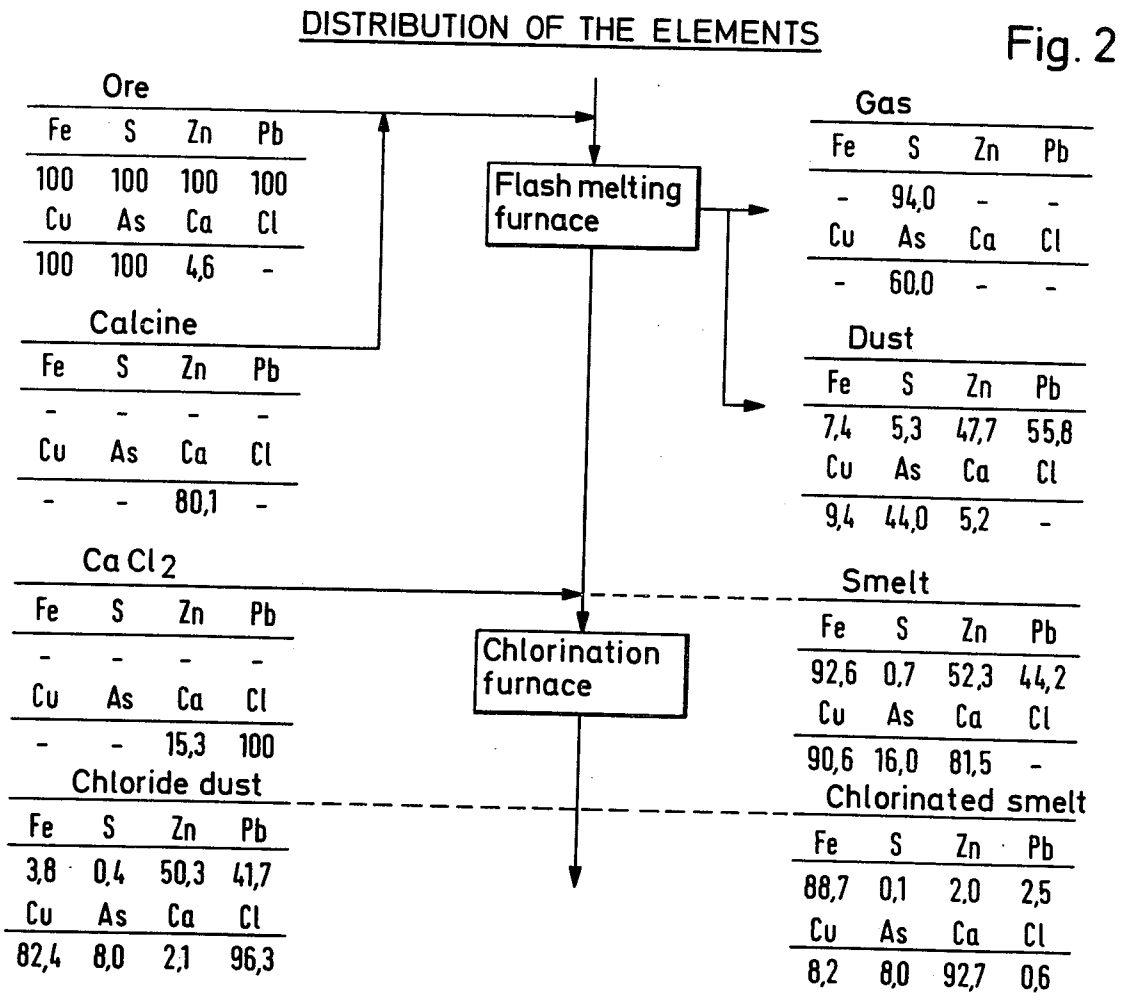

FIG. 2 shows that the total yields of valuable metals passed into the dusts are:

| | |
|---|---|
| Zn | 98.0 |
| Pb | 97.5 |
| Cu | 91.8 |

Differences when compared with Example 1 are due to the higher concentrations of the said metals in the feed and the higher temperature.

TABLE 1

| | Quantity | Fe | | S | | Zn | | Pb | | Cu | | As | |
|---|---|---|---|---|---|---|---|---|---|---|---|---|---|
| | kg | kg | % | kg | % | kg | % | kg | % | kg | % | kg | % |
| FSF | | | | | | | | | | | | | |

TABLE 1-continued

| | | | | | | | | | | | | | |
|---|---|---|---|---|---|---|---|---|---|---|---|---|---|
| Concentrate | 1000 | 410 | 41 | 430 | 43 | 10 | 1.0 | 6 | 0.6 | 1 | 0.1 | 70 | 7.0 |
| Lime | 100 | | | | | | | | | | | | |
| Dust | 153.4 | 32 | 20.9 | 20.9 | 13.6 | 4.1 | 2.7 | 3.2 | 2.1 | 0.1 | 0.06 | 31.4 | 20.5 |
| Melt | 694.5 | 378 | 54.4 | 3.8 | 0.55 | 5.9 | 0.85 | 2.8 | 0.40 | 0.9 | 0.13 | 6.0 | 0.86 |
| Chlorination furnace | | | | | | | | | | | | | |
| Melt | 694.5 | 378 | 54.4 | 3.8 | 0.55 | 5.9 | 0.85 | 2.8 | 0.40 | 0.9 | 0.13 | 6.0 | 0.86 |
| $CaCl_2$ | 48.0 | | | | | | | | | | | | |
| Chloride dust | 67.4 | 15.9 | 23.6 | 1.5 | 2.2 | 5.26 | 7.8 | 2.6 | 3.8 | 0.62 | 0.92 | 5.45 | 8.1 |
| Chlorinated smelt | 687.5 | 362 | 52.7 | 0.4 | 0.06 | 0.64 | 0.09 | 0.21 | 0.03 | 0.28 | 0.04 | 0.55 | 0.08 |

| | Quantity | $SiO_2$ | | CaO | | Au | | Ag | | Cl | |
|---|---|---|---|---|---|---|---|---|---|---|---|
| | kg | kg | % | kg | % | g | g/t | g | g/t | kg | % |
| FSF | | | | | | | | | | | |
| Concentrate | 1000 | 63 | 6.3 | 10 | 1.0 | 18 | 18 | 33 | 33 | | |
| Lime | 100 | | | 100 | 100 | | | | | | |
| Dust | 153.4 | 2.9 | 1.9 | 5.1 | 3.3 | 1.3 | 8.5 | 31 | 20 | | |
| Melt | 694.5 | 60.1 | 8.65 | 104.9 | 15.1 | 16.7 | 24 | 29.9 | 4.3 | | |
| Chlorination furnace | | | | | | | | | | | |
| Melt | 694.5 | 60.1 | 8.65 | 104.9 | 15.1 | 16.7 | 24 | 29.9 | 43 | | |
| $CaCl_2$ | 48.0 | | | | | | | | | 30.7 | 63.9 |
| Chloride dust | 67.4 | 1.0 | 1.5 | 2.6 | 3.8 | 15.5 | 230 | 27.0 | 400 | 29.6 | 43.9 |
| Chlorinated smelt | 687.5 | 59.1 | 8.6 | 126.5 | 18.4 | 1.2 | 1.7 | 2.9 | 4.2 | 0.2 | 0.03 |

TABLE 2

| | Quantity | Fe | | S | | Zn | | Pb | | Cu | | As | | $SiO_2$ | | CaO | | Cl | |
|---|---|---|---|---|---|---|---|---|---|---|---|---|---|---|---|---|---|---|---|
| | kg | kg | % | kg | % | kg | % | kg | % | kg | % | kg | % | kg | % | kg | % | kg | % |
| FSF | | | | | | | | | | | | | | | | | | | |
| Concentrate | 1000 | 390 | 39 | 450 | 45 | 35 | 3.5 | 12 | 1.2 | 8.5 | 0.85 | 5.0 | 0.5 | 57 | 5.7 | 6.7 | 0.67 | | |
| Lime | 120 | | | | | | | | | | | | | | | 120 | 100 | | |
| Dust | 159.1 | 29.0 | 18.2 | 24.0 | 15.1 | 16.7 | 10.5 | 6.7 | 4.2 | 0.8 | 0.50 | 2.2 | 1.4 | 4.4 | 2.8 | 7.6 | 4.8 | | |
| Melt | 730.5 | 361 | 49.4 | 3.0 | 0.41 | 18.3 | 2.5 | 5.3 | 0.72 | 7.7 | 1.05 | 0.8 | 0.11 | 52.6 | 7.2 | 119.1 | 16.3 | | |
| Chlorination furnace | | | | | | | | | | | | | | | | | | | |
| Melt | 730.5 | 361 | 49.4 | 3.0 | 0.41 | 18.3 | 2.5 | 5.3 | 0.72 | 7.7 | 1.05 | 0.8 | 0.11 | 52.6 | 7.2 | 119.1 | 16.3 | | |
| $CaCl_2$ | 54.0 | | | | | | | | | | | | | | | | | 34.5 | 63.9 |
| Chloride dust | 88.1 | 14.8 | 16.8 | 1.8 | 2.0 | 17.6 | 20.0 | 5.0 | 5.7 | 7.0 | 7.9 | 0.4 | 0.45 | 1.1 | 1.2 | 3.1 | 3.5 | 33.2 | 37.7 |
| Chlorinated smelt | 706.0 | 346 | 49.0 | 0.3 | 0.04 | 0.7 | 0.1 | 0.3 | 0.04 | 0.7 | 0.1 | 0.4 | 0.06 | 51.5 | 7.3 | 135.5 | 19.2 | 0.2 | 0.03 |

TABLE 3

| Reaction | 1200K | 1300K | 1400K | 1600K | 1700K | 1800K |
|---|---|---|---|---|---|---|
| 1. $3\ Cu_2O + 3\ CaCl_2(l) = 2\ Cu_3Cl_3(g) + 3\ CaO(s)$ $Cu_2O$: 1200–1509K (s), 1509–1500K l | $1.5 \times 10^{-5}$ | $1.9 \times 10^{-4}$ | $1.6 \times 10^{-3}$ | 0.0173 | 0.026 | 0.036 |
| 2. $ZnO(s) + CaCl_2\ (l) = ZnCl_2(g) + CaO\ (s)$ | $4.1 \times 10^{-4}$ | $1.9 \times 10^{-3}$ | $6.7 \times 10^{-3}$ | 0.05 | 0.11 | 0.22 |
| 3. $PbO\ (l) + CaCl_2\ (l) = PbCl_2 + CaO\ (s)$ $PbCl_2$: 1200–1226K (l), 1226–1800K (g) | 0.155 | 0.302 | 0.65 | 2.07 | 3.22 | 4.68 |
| 4. $PbO\ (g) + CaCl_2\ (l) = PbCl_2 + CaO\ (s)$ | 197.5 | 70.7 | 36.3 | 11.8 | 7.3 | 4.7 |
| 5. $As_2O_3\ (f) + 3\ CaCl_2\ (l) = 2\ AsCl_3\ (g) + 3\ CaO\ (s)$ | $10^{-14.8}$ | $10^{-13}$ | $2.5 \times 10^{-12}$ | $5.0 \times 10^{-10}$ | $4.0 \times 10^{-9}$ | $2 \times 10^{-8}$ |

What is claimed is:

1. A process for the roasting of a finely-divided raw material selected from iron ores and concentrates or both which contain non-ferrous metals and for their chlorination, in order to vaporize the non-ferrous metals as metal chloride compounds, comprising oxidizing the finely-divided raw material at an elevated temperature to produce an oxide melt, and mixing a chlorinating reagent and an oxygen containing gas with the oxide melt in order to vaporize non-ferrous metal chlorides from the iron oxide melt.

2. A process according to claim 1, comprising using as the chlorinating reagent a quantity of calcium chloride at least stoichiometric in relation to the non-ferrous metals to be removed.

3. A process according to claim 2, in which a lime-containing material is added in such a quantity that, together with calcium oxide produced from the chlorinating agent, said lime-containing material lowers the melting point of the chlorinated melt to 1200°–1350° C.

4. A process according to claim 1, comprising adding the calcium chloride in molten state to the oxide melt.

5. A process according to claim 1, in which the powderous raw material is oxidized to so high a degree that the sulfur concentration in the oxide melt to be chlorinated is below 0.6%.

6. A process according to claim 1, in which the powderous raw material and the oxygen containing gas are fed as a suspension at a minimum temperature of 1500° C. from above, causing the suspension to impinge against the oxide melt at 1300°–1500° C. situated below, in order to separate molten and solid particles present in the suspension from the gases and fly dust, which are directed aside and thereafter to a rising reaction zone, and the oxide melt is directed, either as a continuous flow or in batches, to a separate chlorination zone.

7. A process according to claim 6, wherein the fly dust separated from the outlet gases is recycled to the suspension reaction zone in order to cause the non-ferrous metals present in the fly dusts to pass into the oxide melt to be chlorinated.

* * * * *

UNITED STATES PATENT AND TRADEMARK OFFICE

CERTIFICATE OF CORRECTION

PATENT NO. : 4,259,106

DATED : March 31, 1981

INVENTOR(S) : Olavi A. Aaltonen et al

It is certified that error appears in the above-identified patent and that said Letters Patent are hereby corrected as shown below:

Column 2, Line 45: please delete words "in lieu thereof".

Column 4, Line 45: "No. 4,027,865" should read -- No. 4,027,863 --.

Columns 7 & 8, Table 2:

| | Pb kg | Pb % | |
|---|---|---|---|
| Melt | "5.30 | .72" | should be |
| | --5.3 | 0.72-- | |
| Chlorinated smelt | "0.30 | .04" | should be |
| | --0.3 | 0.04--. | |

Signed and Sealed this

Eighth Day of September 1981

[SEAL]

Attest:

GERALD J. MOSSINGHOFF

Attesting Officer

Commissioner of Patents and Trademarks